US009604657B2

(12) United States Patent
Harasaki

(10) Patent No.: US 9,604,657 B2
(45) Date of Patent: Mar. 28, 2017

(54) TRAVELLING VEHICLE SYSTEM

(71) Applicant: MURATA MACHINERY, LTD., Kyoto-shi, Kyoto (JP)

(72) Inventor: Kazumi Harasaki, Inuyama (JP)

(73) Assignee: MURATA MACHINERY, LTD., Kyoto (JP)

( * ) Notice: Subject to any disclaimer, the term of this patent is extended or adjusted under 35 U.S.C. 154(b) by 22 days.

(21) Appl. No.: 14/876,881

(22) Filed: Oct. 7, 2015

(65) Prior Publication Data

US 2016/0232786 A1 Aug. 11, 2016

(30) Foreign Application Priority Data

Oct. 20, 2014 (JP) ..... 2014-213745

(51) Int. Cl.

| | |
|---|---|
| ***G08G 1/01*** | (2006.01) |
| ***B61L 23/00*** | (2006.01) |
| ***B61L 25/02*** | (2006.01) |
| ***B61L 27/00*** | (2006.01) |
| ***B61L 27/04*** | (2006.01) |

(52) U.S. Cl.

CPC ..... *B61L 23/00* (2013.01); *B61L 25/025* (2013.01); *B61L 27/0016* (2013.01); *B61L 27/0094* (2013.01); *B61L 27/04* (2013.01)

(58) Field of Classification Search

CPC ..... B61L 23/00; B61L 25/025; B61L 27/04; B61L 27/0094; B61L 27/0016

See application file for complete search history.

(56) References Cited

U.S. PATENT DOCUMENTS

| | | | | |
|---|---|---|---|---|
| 8,527,088 | B2 * | 9/2013 | Tominaga | H01L 21/67769 414/562 |
| 2010/0228389 | A1 * | 9/2010 | Hayashi | G05D 1/0297 700/229 |
| 2011/0178657 | A1 * | 7/2011 | Harasaki | G05D 1/0272 701/2 |
| 2012/0004767 | A1 * | 1/2012 | Tominaga | H01L 21/67769 700/230 |

FOREIGN PATENT DOCUMENTS

| | | | |
|---|---|---|---|
| JP | 63-153606 | A | 6/1988 |
| JP | 2011-022974 | A | 2/2011 |
| WO | 2010/073475 | A1 | 7/2010 |

* cited by examiner

*Primary Examiner* — Anne M Antonucci
(74) *Attorney, Agent, or Firm* — Keating & Bennett, LLP

(57) ABSTRACT

A travelling vehicle system additionally sets a waiting point such that a number of waiting points is equal to a number of empty travelling vehicles present on a travelling route upon detection of an empty travelling vehicle. The system searches a route from a start point to an end point when the additionally set one waiting point is taken as the start point and a position of one empty travelling vehicle is taken as the end point, the one empty travelling vehicle being detected by a detection portion and not waiting at the waiting point. The system allocates to the other empty travelling vehicle the travelling command to move to the one waiting point and allocates to the one empty travelling vehicle the travelling command to move to the other waiting point which becomes empty by movement of the other empty travelling vehicle.

6 Claims, 8 Drawing Sheets

TRAVELLING VEHICLE SYSTEM

BACKGROUND OF THE INVENTION

1. Field of the Invention

The present invention relates to a travelling vehicle system that causes a travelling vehicle to travel on a predetermined travelling route.

2. Description of the Related Art

There is a travelling vehicle system for causing a travelling vehicle automatically to travel on a travelling route by computer control, the travelling route being previously provided on a ceiling, a floor, or the like and including a plurality of one-way circulation routes. In such a travelling vehicle system, loading (loading of an article from a station onto a carrier) or unloading (unloading of an article from the carrier to the station) is performed between the station and the travelling vehicle. In this travelling vehicle system, when a request for loading an article is issued from a certain station, a conveyance command to move to the station and receive the article is allocated to an empty carrier located at the nearest position.

After unloading, the travelling vehicle becomes a travelling vehicle in an empty state in which an article is not loaded (hereinafter referred to as an "empty travelling vehicle"). Such an empty travelling vehicle is stopped at a waiting point provided on the travelling route, to prepare for the next conveyance command (e.g., see W02010/73475 A1).

In such a system, it is desired to reliably make the empty travelling vehicle wait at the waiting point as described above. For example, by reliably making the empty travelling vehicle wait at the waiting point, it is possible to suppress wasteful energy consumption. Further, for example, when the waiting point is set near the station in which the loading request is issued, it is also possible to enhance conveyance efficiency of the travelling vehicle system.

SUMMARY OF THE INVENTION

Accordingly, preferred embodiments of the present invention provide a travelling vehicle system capable of reliably making an empty travelling vehicle wait at a waiting point.

A travelling vehicle system according to a preferred embodiment of the present invention is a travelling vehicle system including a predetermined one-way travelling route; a plurality of travelling vehicles that travel along the travelling route; and a controller that allocates a travelling command to each of the travelling vehicles. The controller is configured or programmed to include a detection portion that detects presence or absence of an empty travelling vehicle not loaded with an object to be conveyed, a setting portion that additionally sets a waiting point such that the number of waiting points is equal to the number of the empty travelling vehicles present on the travelling route upon detection of the empty travelling vehicle by the detection portion, the waiting point being a point at which the empty travelling vehicle is made to wait on the travelling route, a route searching portion that searches a route from a start point to an end point when one waiting point additionally set by the setting portion is taken as the start point and a position of one empty travelling vehicle is taken as the end point, the one empty travelling vehicle being detected by the detection portion and not waiting at the waiting point, and a travelling command allocation portion that allocates to the one empty travelling vehicle the travelling command to move to the one waiting point along the route when the other empty travelling vehicle is not present in the route searched by the route searching portion, or allocates to the other empty travelling vehicle the travelling command to move to the one waiting point and allocates to the one empty travelling vehicle the travelling command to move to the other waiting point which becomes empty by movement of the other empty travelling vehicle when the other empty travelling vehicle waiting at the other waiting point is present in the route searched by the route searching portion.

According to the travelling vehicle system with this configuration, since the waiting point is set upon detection of the empty travelling vehicle, it is possible to prevent the number of waiting points from becoming smaller than the number of empty travelling vehicles. Further, the route is searched with one waiting point as the start point and one empty travelling vehicle not waiting at the waiting point as the end point, and along the searched route, the one empty travelling vehicle not waiting at the waiting point is moved to the one waiting point. In the conventional technique of calling the nearest empty travelling vehicle onto the waiting point regardless of whether or not the empty travelling vehicle is waiting at the waiting point, for example, such a phenomenon may occur that one empty travelling vehicle already waiting at one of the two waiting points is called onto the other of the two waiting points, and vice versa. In this case, an empty travelling vehicle not waiting at the waiting point is not called onto either of the two waiting points. In contrast, in the travelling vehicle system with the above-described configuration, control is performed such that one empty travelling vehicle not waiting at the waiting point is set as a target and called onto the waiting point, such that it is possible to reliably move the one empty travelling vehicle not waiting at the waiting point to the waiting point. Further, even when the other empty travelling vehicle waiting at the other waiting point is present within the searched route, the one empty travelling vehicle and the other empty travelling vehicle are moved along the searched route, and the one empty travelling vehicle and the other empty travelling vehicle are moved to the waiting points set in the route. As a result, it is possible to reliably make the empty travelling vehicle wait at the waiting point.

In a travelling vehicle system according to a preferred embodiment of the present invention, when the number of the other waiting points and the number of the other empty travelling vehicles are plural, the travelling command allocation portion may allocate to each of the other empty travelling vehicles the travelling command to move to the one waiting point adjacent to the start point side or the other waiting point while keeping order of the other empty travelling vehicles arranged from the start point side toward the end point side along the route, and allocate the travelling command to move the one empty travelling vehicle to the other waiting point which becomes empty by the movement of the other empty travelling vehicle, the other empty travelling vehicle being located on a farthermost end side within the route.

According to such a travelling vehicle system, even when the number of the other waiting points and the number of the other empty travelling vehicles are plural in the route with the one waiting point additionally set by the setting portion as the start point and a position of the one empty travelling vehicle detected by the detection portion as the end point, it is possible to reliably make the empty travelling vehicle wait at the waiting point.

In a travelling vehicle system according to a preferred embodiment of the present invention, the detection portion preferably detects the presence or absence of the empty travelling vehicle at preset setting time intervals.

According to such a travelling vehicle system, it is not necessary to continuously monitor an empty state of the travelling vehicle travelling on the track, thus allowing reduction in load of the controller. Further, it is possible to move the empty travelling vehicle to the waiting point by use of a period in which a load applied to the controller is small.

A travelling vehicle system according to a preferred embodiment of the present invention may further include an abnormality determination portion that determines occurrence of an abnormality in the one empty travelling vehicle when the one empty travelling vehicle does not arrive at the waiting point instructed by the travelling command within predetermined time after the travelling command allocation portion allocates the travelling command to the one empty travelling vehicle.

According to such a travelling vehicle system, it is possible to detect an abnormality of the travelling vehicle system with a simple configuration.

In a travelling vehicle system according to a preferred embodiment of the present invention, when a plurality of routes are extracted, the route searching portion may select the route having a shortest distance from the start point to the end point.

According to such a travelling vehicle system, it is possible to move the empty travelling vehicle to the waiting point in a short period of time.

When a plurality of routes are extracted, the route searching portion may select the route having a minimum number of the other waiting points at which the other empty travelling vehicles are waiting.

According to such a travelling vehicle system, it is possible to prevent the other empty travelling vehicle waiting at the other waiting point from being forced out.

According to various preferred embodiments of the present invention, it is possible to reliably make the empty travelling vehicle wait at the waiting point.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
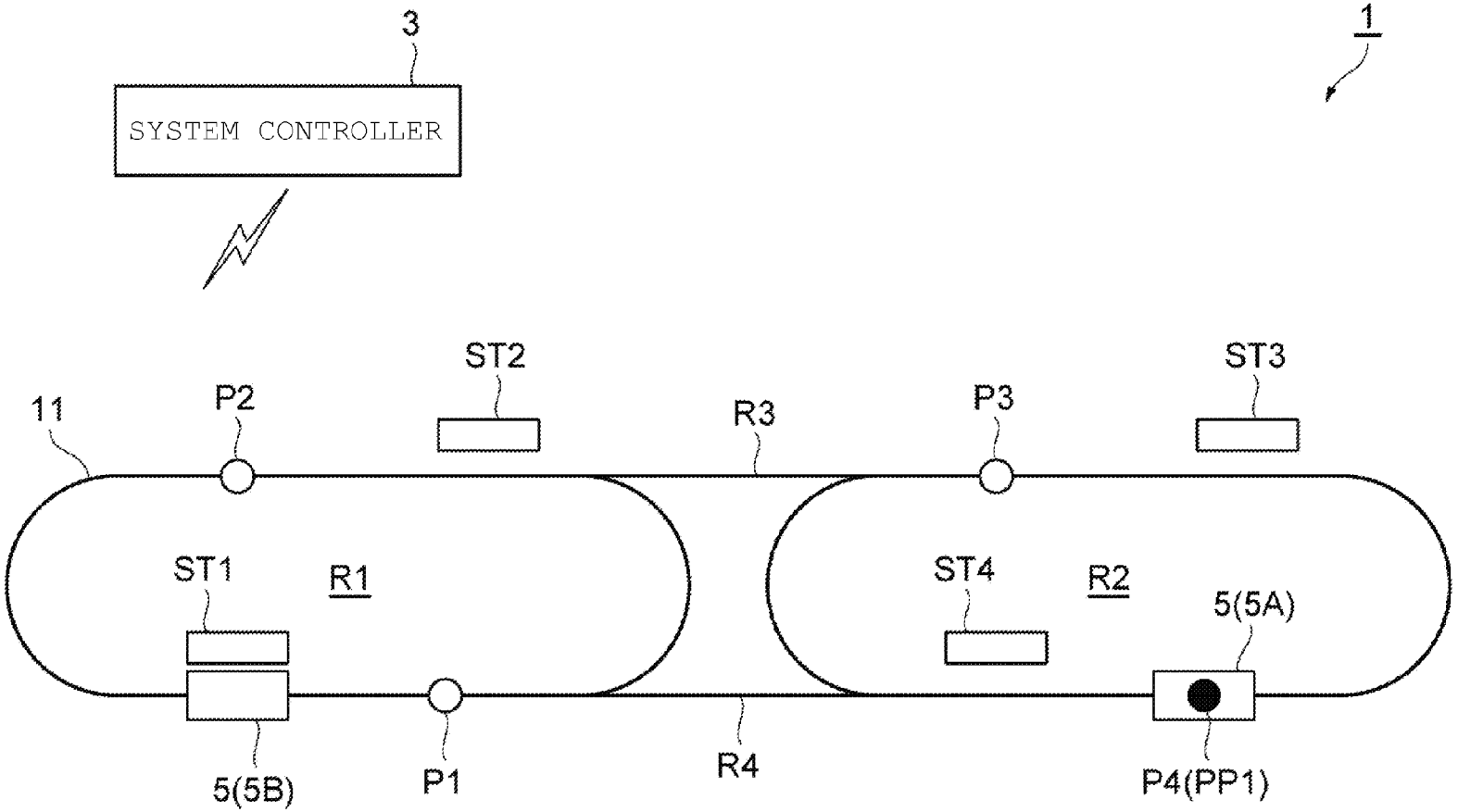
FIG. 1 is a configuration diagram illustrating a configuration of a travelling vehicle system according to a preferred embodiment of the present invention.

Hereinafter, preferred embodiments of the present invention will be described with reference to the drawings. In the description of the drawings, the same reference numeral is used to denote the same element, and redundant description will be omitted. A size ratio of the drawings is not necessarily consistent with that in the description.

A travelling vehicle system 1 is a system for conveying an object to be conveyed by using an overhead travelling vehicle (travelling vehicle) 5 movable along a track (travelling route). Here, for example, a description will be given by taking as an example the travelling vehicle system 1 in a factory or the like in which the overhead travelling vehicle (travelling vehicle) 5 (hereinafter simply referred to as "travelling vehicle 5") travels along a one-way track laid on a ceiling of the factory or the like. As illustrated in FIG. 1, the travelling vehicle system 1 includes a track 11, a plurality of stations (ST1, ST2, ST3, ST4), a plurality of travelling vehicles 5 (5A to 5D), and a system controller (controller) 3.

The track 11 enables the travelling vehicle 5 to travel, and is preferably hung from the ceiling. FIG. 1 illustrates a layout of the track 11 in the present preferred embodiment. In the present preferred embodiment, the track 11 includes two loop travelling routes R1, R2, and two connection travelling routes R3, R4 that connect between the adjacent loop travelling routes R1, R2 so as to allow mutual travelling therebetween. The loop travelling routes R1, R2 are set such that the travelling vehicle 5 travels in a one-way clockwise manner.

The stations (ST1, ST2, ST3, ST4) each give and receive an object to be conveyed to and from the travelling vehicle 5. The stations (ST1, ST2, ST3, ST4) are provided along the track 11. Further, on the upstream sides of the stations (ST1, ST2, ST3, ST4), candidate points P1, P2, P3, P4 which are points to be candidates for a waiting point are set. The waiting point is set by a system controller 3 that will be described in detail later.

Figure 2:
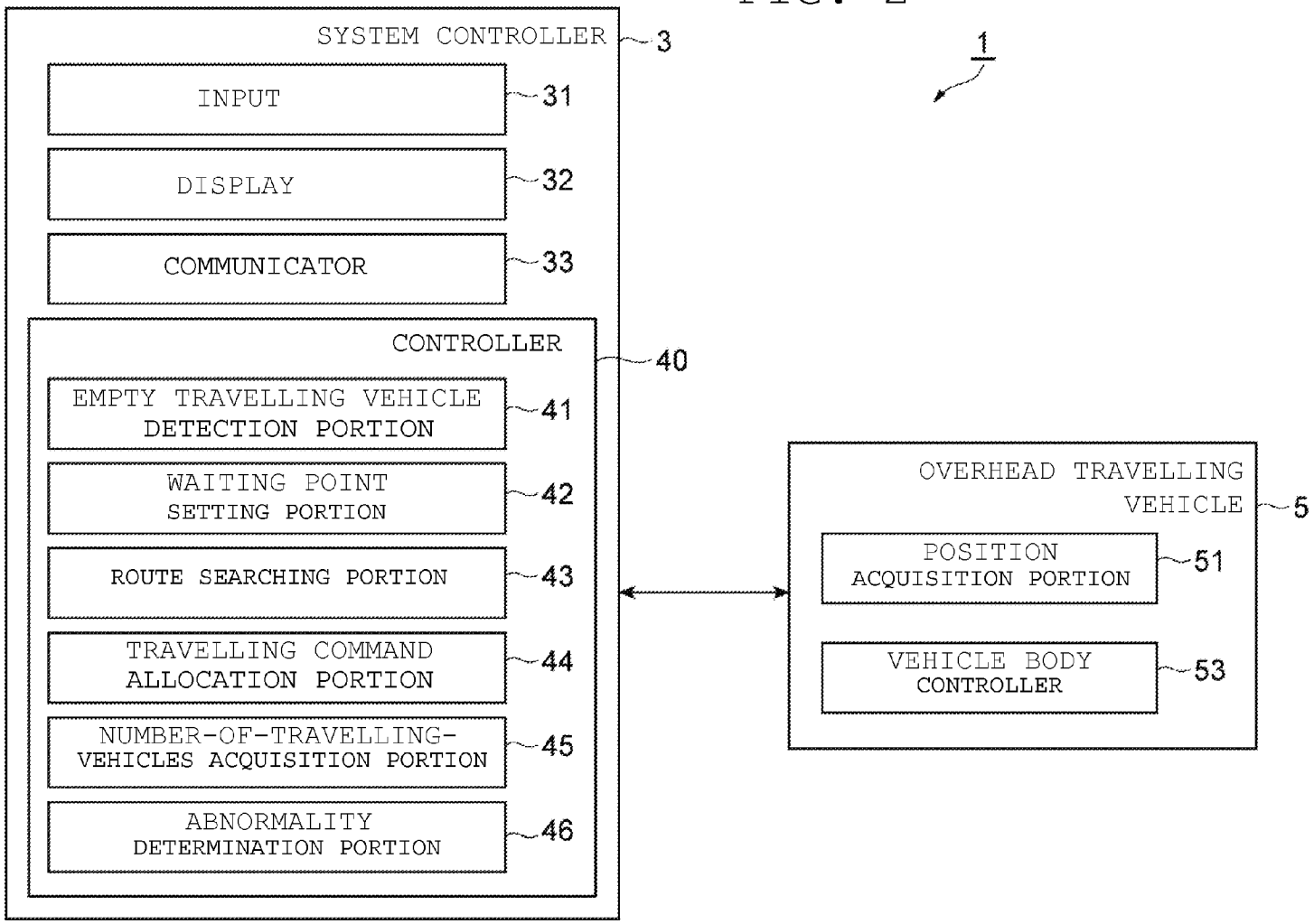
FIG. 2 is a functional block diagram illustrating a functional configuration of the travelling vehicle system of FIG. 1.

The travelling vehicle 5 is capable of transferring a general article that is an object to be conveyed. Note that, examples of the object to be conveyed include a semiconductor wafer, a glass substrate, and general parts. As illustrated in FIG. 2, the travelling vehicle 5 is provided with a position acquisition portion 51 and a vehicle body controller 53 in addition to the mechanism to transfer the object to be conveyed.

The position acquisition portion 51 is a portion that acquires a position of its own vehicle on the track 11. The position acquisition portion 51 may include a reading portion, which reads a barcode or the like being affixed to the track 11 and showing point information, and an encoder or the like, for example. The position acquisition portion 51 transmits, to the system controller 3, the point information obtained by the reading portion and a travelling distance after passage through the point which is obtained by the encoder, as position data.

The vehicle body controller 53 is configured or programmed to control travelling of the travelling vehicle 5, and preferably is an electronic control unit including a CPU (Central Processing Unit), a ROM (Read Only Memory), a RAM (Random Access Memory), and the like, for example.

The vehicle body controller 53 is configured or programmed to control travelling of the travelling vehicle 5 based on a conveyance command transmitted from the system controller 3. Note that the conveyance command will be described in detail later.

The system controller 3 is configured or programmed to control the travelling vehicle 5. The system controller 3 has an allocation function to allocate a conveyance command to each of a plurality of travelling vehicles 5. This conveyance command includes a command concerning travelling and a command concerning a loading position and an unloading position.

As illustrated in FIG. 2, the system controller 3 is provided with an input 31, a display 32, a communicator 33, and a controller 40. The input 31 preferably is, for example, a keyboard, a mouse, or the like, and in which a variety of operations and a variety of set values are inputted by a user. The display 32 preferably is, for example, a liquid crystal display or the like, and displays a variety of setting screens or displays an input screen or the like for making an input by the input 31.

The communicator 33 preferably is a processor configured or programmed to communicate with another device or the like, and for example, the communicator 33 transmits the conveyance command to the travelling vehicle 5 and receives information concerning a current position of the travelling vehicle 5 and loading or non-loading of the object to be conveyed via a wireless communication network. Further, for example, the communicator 33 also receives from a host controller a conveyance instruction including information of stations to be a start point and an end point via a LAN (Local Area Network).

The controller 40 is configured or programmed to execute a variety of control processing in the travelling vehicle system 1 which will be described in detail later, and preferably includes a CPU, a ROM, a RAM, a hard disk, and the like, for example. As illustrated in FIG. 2, as conceptual portions that execute the variety of control processing in the travelling vehicle system 1, the controller 40 is configured or programmed to include an empty travelling vehicle detection portion (detection portion) 41, a waiting point setting portion (setting portion) 42, a route searching portion 43, a travelling command allocation portion 44, a number-of-travelling-vehicles acquisition portion (setting portion) 45, and an abnormality determination portion 46. Such conceptual portions can be software in which a program stored in the ROM is loaded on the RAM and executed by the CPU, for example. Note that the controller 40 may be configured as hardware made up of an electronic circuit or the like.

The empty travelling vehicle detection portion 41 detects presence or absence of an empty travelling vehicle not loaded with the object to be conveyed. Specifically, the empty travelling vehicle detection portion 41 makes an inquiry to each travelling vehicle 5 about loading or non-loading of the object to be conveyed in a constant cycle. The vehicle body controller 53 having received the inquiry transmits information concerning the loading or non-loading of the object to be conveyed to the empty travelling vehicle detection portion 41. Based on this response to the inquiry, the empty travelling vehicle detection portion 41 determines whether or not the travelling vehicle 5 is an empty travelling vehicle. That is, the empty travelling vehicle detection portion 41 detects that the empty travelling vehicle has been generated.

Upon detection of the empty travelling vehicle by the empty travelling vehicle detection portion 41, the waiting point setting portion 42 additionally sets a waiting point (one waiting point) as a point at which the empty travelling vehicle is made to wait on the track 11. Specifically, when the empty travelling vehicle detection portion 41 detects the generation of the empty travelling vehicle, the waiting point setting portion 42 sets the waiting point out of candidate points to be candidates for the waiting point based on a predetermined rule.

One non-limiting example of the predetermined rule will be described. For example, the order of priority is previously given to the candidate points. The order of priority can be set based on a positional relation with a station having a high operation rate, or the like. Based on the order of priority, the waiting point setting portion 42 sets the waiting point out of a plurality of candidate points.

When the route searching portion 43 takes the one waiting point additionally set by the waiting point setting portion 42 as a start point and a position of the one empty travelling vehicle detected by the empty travelling vehicle detection portion 41 as an end point, the route searching portion 43 searches a route from the start point to the end point.

When the other empty travelling vehicle is not present in the route searched by the route searching portion 43, the travelling command allocation portion 44 allocates to the one empty travelling vehicle a travelling command to move to the one waiting point along the route. Further, when the other empty travelling vehicle waiting at the other waiting point is present in the route searched by the route searching portion 43, the travelling command allocation portion 44 allocates to the other empty travelling vehicle the travelling command to move to the one waiting point, and also allocates to the one empty travelling vehicle the travelling command to move to the other waiting point, which will become empty by movement of the other empty travelling vehicle.

The number-of-travelling-vehicles acquisition portion 45 acquires the number of empty travelling vehicles present on the track 11. Specifically, the number-of-travelling-vehicles acquisition portion 45 detects the number of empty travelling vehicles based on the information concerning the loading or non-loading of the object to be conveyed, the information having been received by the empty travelling vehicle detection portion 41.

In a case where one empty travelling vehicle has not arrived at the waiting point instructed by the travelling command within predetermined time after allocation of the travelling command to the one empty travelling vehicle by the travelling command allocation portion 44, the abnormality determination portion 46 determines that an abnormality has occurred in the one empty travelling vehicle. For example, in FIG. 4A, in a case where the abnormality determination portion 46 detects that an empty travelling vehicle 5B has not arrived at a waiting point PP2 even after a lapse of predetermined time (e.g., 60 seconds) from allocation of the travelling command to move to the waiting point PP2 to the empty travelling vehicle 5B by the travelling command allocation portion 44, the abnormality determination portion 46 determines that an abnormality has occurred in the empty travelling vehicle 5B, namely, an abnormality has occurred in the travelling vehicle system 1.

Figure 3:
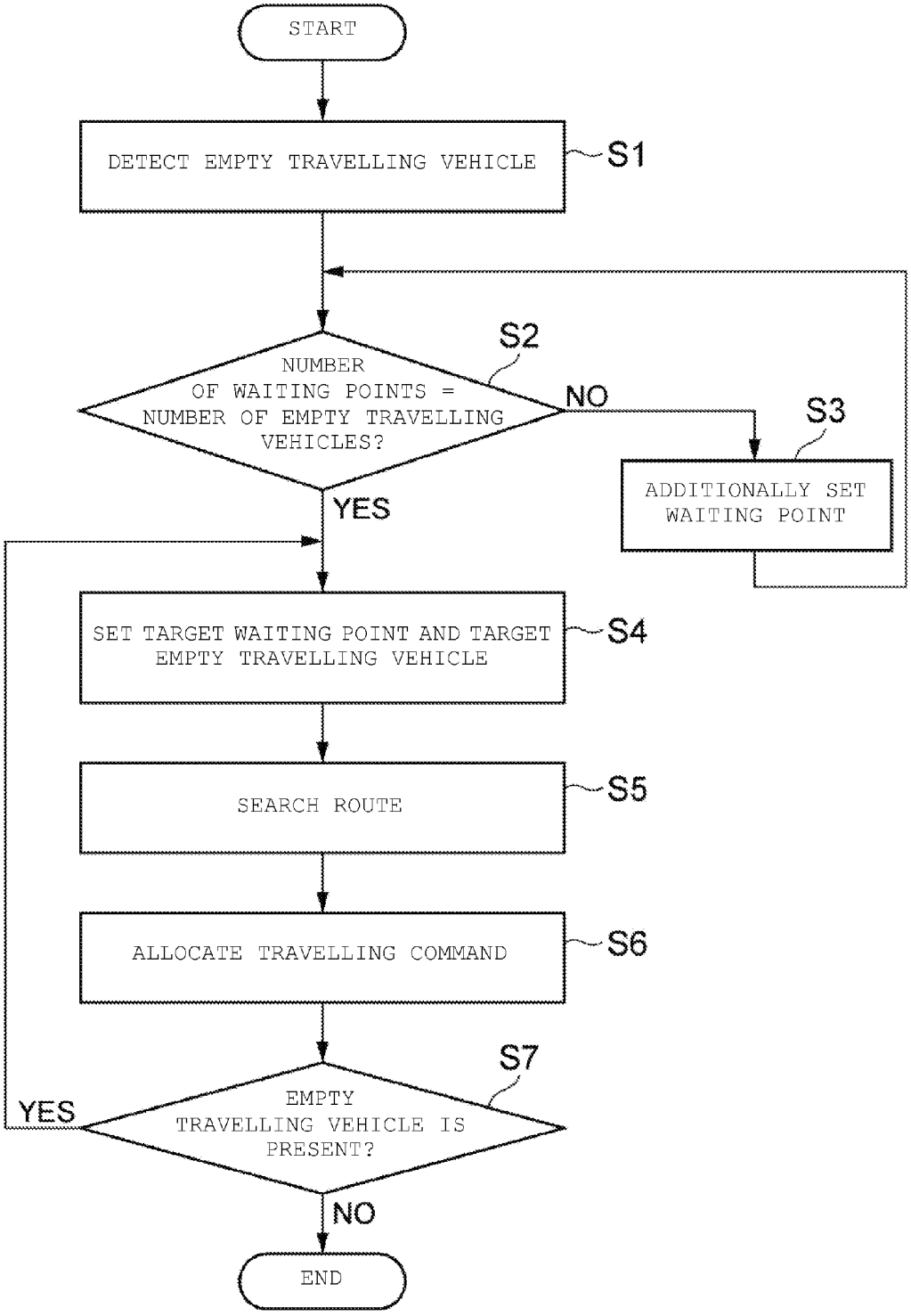
FIG. 3 is a flowchart showing waiting control according to a preferred embodiment of the present invention.

Next, mainly with reference to FIGS. 3 to 5, a description will be given of waiting control in the system controller 3 with respect to each pattern shown below. The waiting control mentioned here refers to control of moving a new empty travelling vehicle to the waiting point when the new empty travelling vehicle is generated.

(A) When the other empty travelling vehicle is not present in the route searched by the route searching portion 43

(B) When the other empty travelling vehicle is present in the route searched by the route searching portion 43

(A) When the other empty travelling vehicle is not present in the route searched by the route searching portion 43

A description will be given with reference to FIGS. 3, 4A, and 4B. First, the empty travelling vehicle detection portion 41 makes an inquiry to each travelling vehicle 5 about loading or non-loading of the object to be conveyed in a constant cycle. Based on a response to the inquiry to the travelling vehicle 5, the empty travelling vehicle detection portion 41 detects whether or not the empty overhead travelling vehicle (empty travelling vehicle) has been newly generated. Here, as illustrated in FIG. 4A, it is assumed that the empty travelling vehicle detection portion 41 has detected the new empty travelling vehicle 5B (one empty travelling vehicle) (Step S1).

Next, the number-of-travelling-vehicles acquisition portion 45 acquires the number of empty travelling vehicles present on the track 11, and determines whether or not the number of waiting points is equal to the number of empty travelling vehicles (Step S2). Here, as illustrated in FIG. 4A, the number of waiting points PP1 is 1 and the number of empty travelling vehicles 5A, 5B is 2, and hence the number-of-travelling-vehicles acquisition portion 45 determines that the number of waiting points PP1 is not equal to the number of empty travelling vehicles 5A, 5B (S2: NO).

Figure 4A:
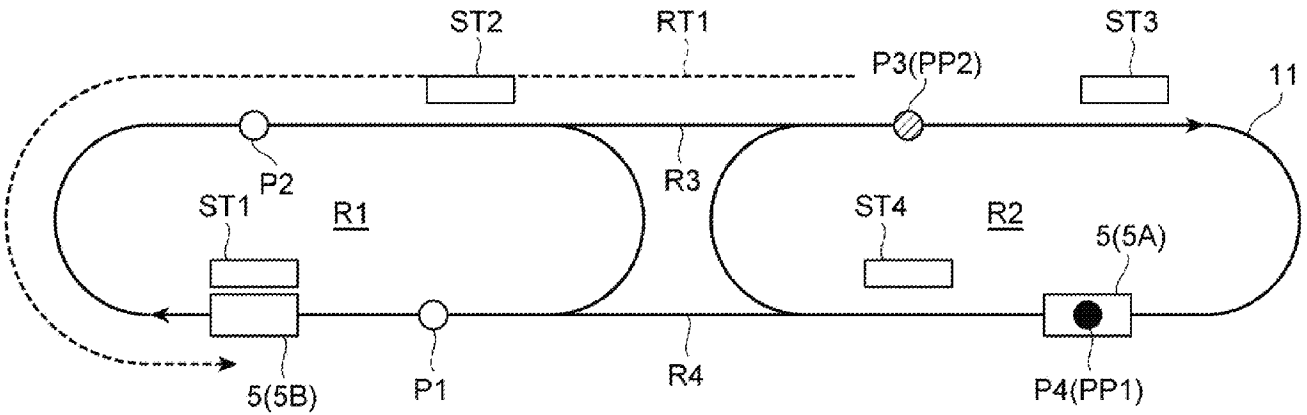
FIGS. 4A and 4B are explanatory diagrams for describing the waiting control according to a preferred embodiment of the present invention.
Figure 4B:
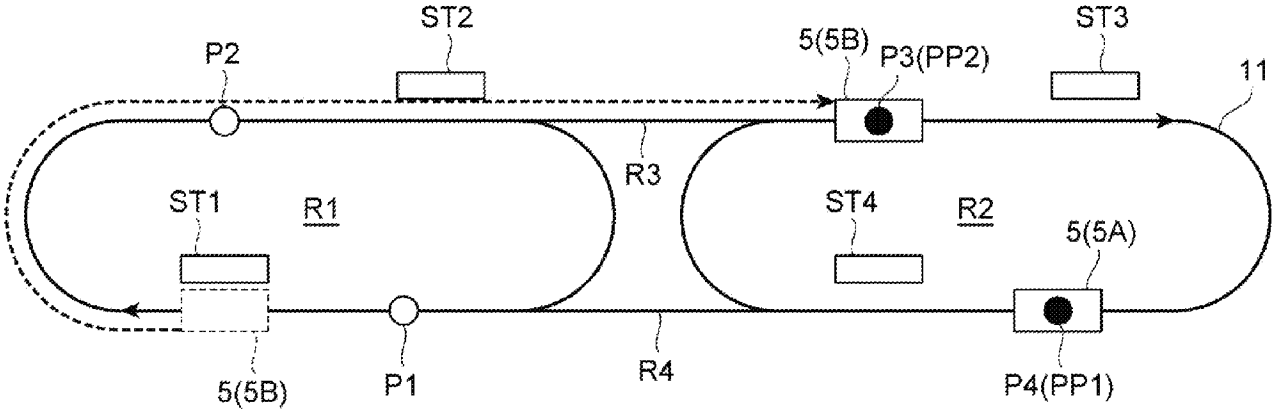

In this case, as illustrated in FIG. 4A, based on the predetermined rule, the waiting point setting portion 42 additionally sets the candidate point P3 as the waiting point PP2 (one waiting point) out of the candidate points P3, P2, P1 in the track 11 (Step S3) . Then, the number-of-travelling-vehicles acquisition portion 45 again acquires the number of empty travelling vehicles present on the track 11, and again determines whether or not the number of waiting points is equal to the number of empty travelling vehicles (Step S2). Here, the number of waiting points PP1, PP2 is 2 and the number of empty travelling vehicles 5A, 5B is 2, and hence the number-of-travelling-vehicles acquisition portion 45 determines that the number of waiting points PP1, PP2 is equal to the number of empty travelling vehicles 5A, 5B (S2: YES).

Next, the route searching portion 43 sets a target waiting point as the start point and a target empty travelling vehicle as the end point. Here, as illustrated in FIG. 4A, the route searching portion 43 sets as the start point the waiting point PP2 additionally set by the waiting point setting portion 42, and sets as the endpoint a position of the empty travelling vehicle 5B detected by the empty travelling vehicle detection portion 41 (Step S4).

Next, the route searching portion 43 searches a route from the waiting point PP2 to the empty travelling vehicle 5B (Step S5). A broken-line arrow illustrated in FIG. 4A is a route RT1 searched by the route searching portion 43.

Next, the travelling command allocation portion 44 allocates the travelling command to the travelling vehicle 5B (Step S6). Here, since the other empty travelling vehicle is not present in the route RT1 searched by the route searching portion 43, the travelling command allocation portion 44 allocates to the empty travelling vehicle 5B the travelling command to move to the waiting point PP2 along the route RT1. Accordingly, as illustrated in FIG. 4B, the empty travelling vehicle 5B moves to the waiting point PP2.

Next, the travelling command allocation portion 44 determines whether or not the empty travelling vehicle not waiting at the waiting point is present (Step S7). For example, based on position data transmitted from the position acquisition portion 51 provided in each travelling vehicle 5 and position data of each waiting point, the travelling command allocation portion 44 determines whether or not the empty travelling vehicle not waiting at the waiting point is present. Here, as illustrated in FIG. 4B, it is determined that the empty travelling vehicle not waiting at the waiting point is not present (S7: NO), and a series of waiting control is completed. When it is determined that the empty travelling vehicle not waiting at the waiting point is present (S7: YES), the processing returns to Step S4. As thus described, by the waiting control in Step S1 to Step S7, it is possible to reliably make the respective empty travelling vehicles 5A, 5B wait at the respective waiting points PP1, PP2.

(B) When the other empty travelling vehicle waiting at the other waiting point is present in the route searched by the route searching portion 43

A description will be given with reference to FIGS. 3, 5A, and 5B. First, the empty travelling vehicle detection portion 41 makes an inquiry to each travelling vehicle 5 about loading or non-loading of the object to be conveyed in a constant cycle. Based on a response to the inquiry to the travelling vehicle 5, the empty travelling vehicle detection portion 41 detects whether or not the empty travelling vehicle has been newly generated. Here, as illustrated in FIG. 5A, it is assumed that the empty travelling vehicle detection portion 41 has detected the new empty travelling vehicle 5B (one empty travelling vehicle) (Step S1).

Next, the number-of-travelling-vehicles acquisition portion 45 acquires the number of empty travelling vehicles present on the track 11, and determines whether or not the number of waiting points is equal to the number of empty travelling vehicles (Step S2). Here, as illustrated in FIG. 5A, the number of waiting points PP1, PP3 is 2 and the number of empty travelling vehicles 5A, 5B, 5C is 3, and hence the number-of-travelling-vehicles acquisition portion 45 determines that the number of waiting points PP1, PP3 is not equal to the number of empty travelling vehicles 5A, 5B, 5C (S2: NO).

Figure 5A:
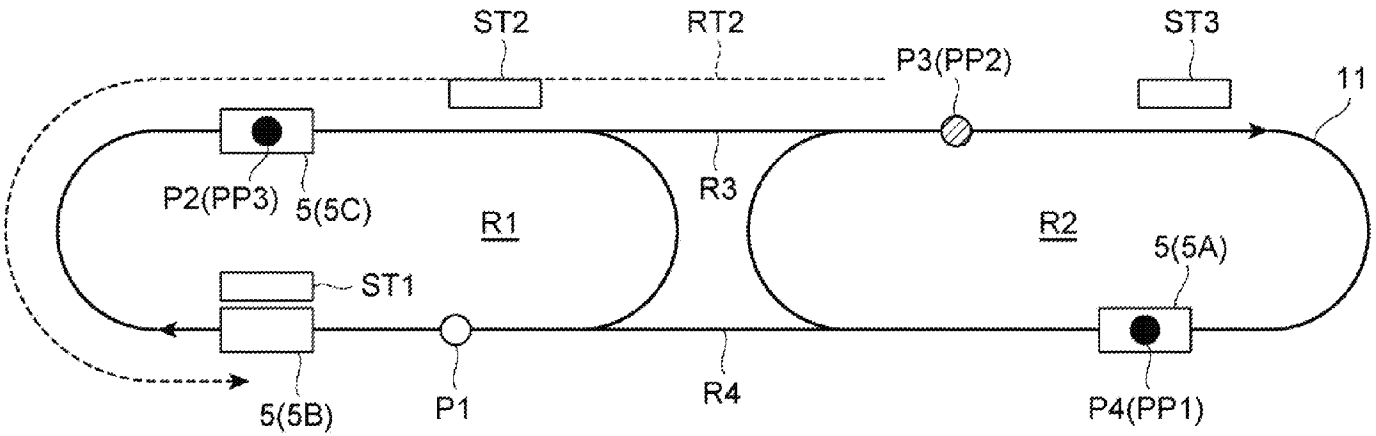
FIGS. 5A and 5B are explanatory diagrams for describing the waiting control according to a preferred embodiment of the present invention.
Figure 5B:
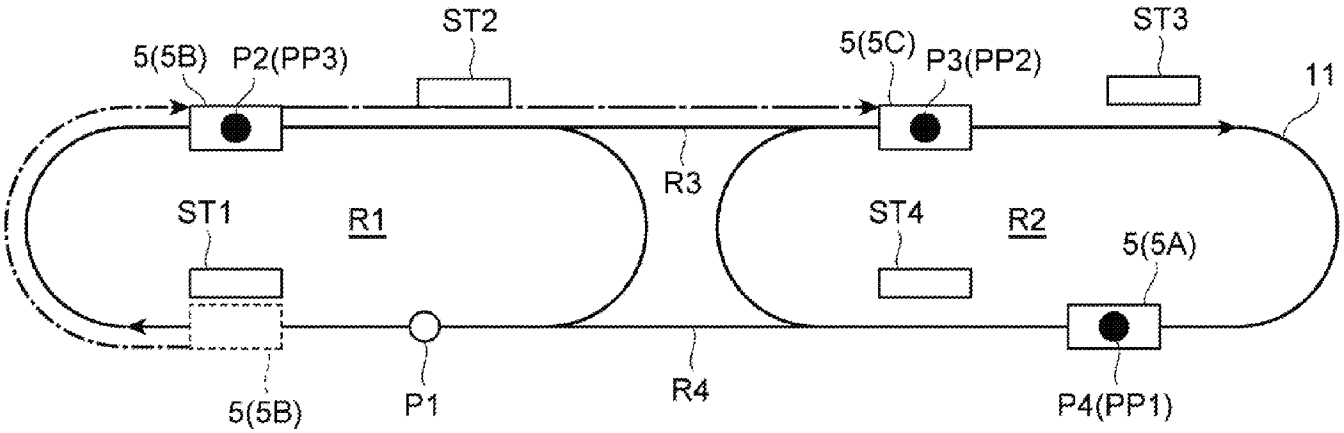

In this case, as illustrated in FIG. 5A, based on the predetermined rule, the waiting point setting portion 42 additionally sets the candidate point P3 as the waiting point PP2 out of the candidate points P3, P1 in the track 11 (Step S3). Then, the number-of-travelling-vehicles acquisition portion 45 again acquires the number of empty travelling vehicles present on the track 11, and again determines whether or not the number of waiting points is equal to the number of empty travelling vehicles (Step S2) . Here, the number of waiting points PP1, PP2, PP3 is 3 and the number of empty travelling vehicles 5A, 5B, 5C is 3, and hence the number-of-travelling-vehicles acquisition portion 45 determines that the number of waiting points PP1, PP2, PP3 is equal to the number of empty travelling vehicles 5A, 5B, 5C (S2: YES).

Next, the route searching portion 43 sets a target waiting point as the start point and a target empty travelling vehicle as the end point. Here, as illustrated in FIG. 5A, the route searching portion 43 sets as the start point the waiting point PP2 (the one waiting point) additionally set by the waiting point setting portion 42, and sets as the endpoint a position of the empty travelling vehicle 5B detected by the empty travelling vehicle detection portion 41 (Step S4).

Next, the route searching portion 43 searches a route from the waiting point PP2 to the empty travelling vehicle 5B (Step S5). A broken-line arrow illustrated in FIG. 5A is a route RT2 searched by the route searching portion 43.

Next, the travelling command allocation portion 44 allocates the travelling command to the travelling vehicle 5B (Step S6). Here, since the other empty travelling vehicle 5C is present in the route RT2 searched by the route searching portion 43, the travelling command allocation portion 44 allocates to the empty travelling vehicle 5C the travelling command to move to the waiting point PP2, and allocates to the empty travelling vehicle 5B the travelling command to move to a waiting point PP3 (the other waiting point) which will become the empty waiting point by movement of the empty travelling vehicle 5C. Accordingly, as illustrated in FIG. 5B, the empty travelling vehicle 5C moves to the waiting point PP2, and the empty travelling vehicle 5B moves to the waiting point PP3.

Next, the travelling command allocation portion 44 determines whether or not the empty travelling vehicle not waiting at the waiting point is present (Step S7). Here, as illustrated in FIG. 5B, it is determined that the empty travelling vehicle not waiting at the waiting point is not present (S7: NO), and a series of waiting control is completed. When it is determined that the empty travelling vehicle not waiting at the waiting point is present (S7: YES), the processing returns to Step S4. By the waiting control in Step S1 to Step S7, it is possible to reliably make the respective empty travelling vehicles 5A to 5C wait at the respective waiting points PP1 to PP3.

According to the travelling vehicle system 1 of the above-described preferred embodiment, for example, as illustrated in FIG. 4A, it is possible to set the waiting point PP2 upon detection of the empty travelling vehicle 5C, so as to prevent the number of waiting points PP1, PP2 from being smaller than the number of empty travelling vehicles 5A, 5B. Further, for example, as illustrated in FIG. 4A, the route is searched with the one waiting point PP3 as the start point and the one empty travelling vehicle 5B not waiting at the waiting point as the end point, and for example, as illustrated in FIG. 4B, one empty travelling vehicle 5B not waiting at the target waiting point along the searched route RT1 is moved to the one waiting point PP2.

In the conventional technique of calling the nearest empty travelling vehicle onto the waiting point regardless of whether or not the empty travelling vehicle is waiting at the waiting point, such a phenomenon may occur in which one empty travelling vehicle already waiting at one of the two waiting points is called onto the other of the two waiting points, and vice versa. Specifically, for example in FIG. 4A, when the waiting point PP2 is newly set, the empty travelling vehicle 5A waiting at the nearest waiting point PP1 is called from the waiting point PP2. The empty travelling vehicle 5A called onto the waiting point PP2 is again called onto the waiting point PP1. That is, there occurs a phenomenon in which the one waiting point PP1 (PP2) out of the two waiting points calls thereonto the one empty travelling vehicle 5A that has already been waiting at the other waiting point PP2 (PP1) out of the two waiting points. In contrast, in the travelling vehicle system 1 of the present preferred embodiment, the control is performed such that the one empty travelling vehicle 5B not waiting at the waiting point is set as a target and called, and hence it is possible to reliably move the one empty travelling vehicle 5B not waiting at the waiting point to the waiting point.

Further, for example, as illustrated in FIG. 5A, even when the other empty travelling vehicle 5C waiting at the other waiting point PP3 is present within the searched route RT2, the one empty travelling vehicle 5B and the other empty travelling vehicle 5C are moved along the searched route RT2, and the one empty travelling vehicle 5B and the other empty travelling vehicle 5C are respectively moved to the waiting points PP2, PP3 in the route. As a result, for example, as illustrated in FIG. 5B, it is possible to reliably make the empty travelling vehicles 5A, 5B wait at the waiting points PP1, PP2. Then, for example as illustrated in FIG. 5B, it is possible to reliably make the empty travelling vehicles 5A, 5B, 5C wait at the waiting points PP1, PP2, PP3.

In the travelling vehicle system 1 of the above-described preferred embodiment, since the empty travelling vehicle detection portion 41 detects the presence or absence of the empty travelling vehicle at the preset setting time intervals, it is possible to reduce a load of the system controller 3. Further, it is possible to execute the waiting control by use of a period in which a load applied to the system controller 3 is small.

In the travelling vehicle system 1 of the above-described preferred embodiment, the waiting point setting portion 42 additionally sets the waiting point such that the number of waiting points is equal to the number of empty travelling vehicles acquired by the number-of-travelling-vehicles acquisition portion 45, such that it is possible to reliably make the empty travelling vehicle wait at the waiting point.

Although one preferred embodiment of the present invention has been described above, the present invention is not limited to the above-described preferred embodiment, and various modifications can be made in a range not deviating from the gist of the present invention.

First Alternative Preferred Embodiment

Figure 6:
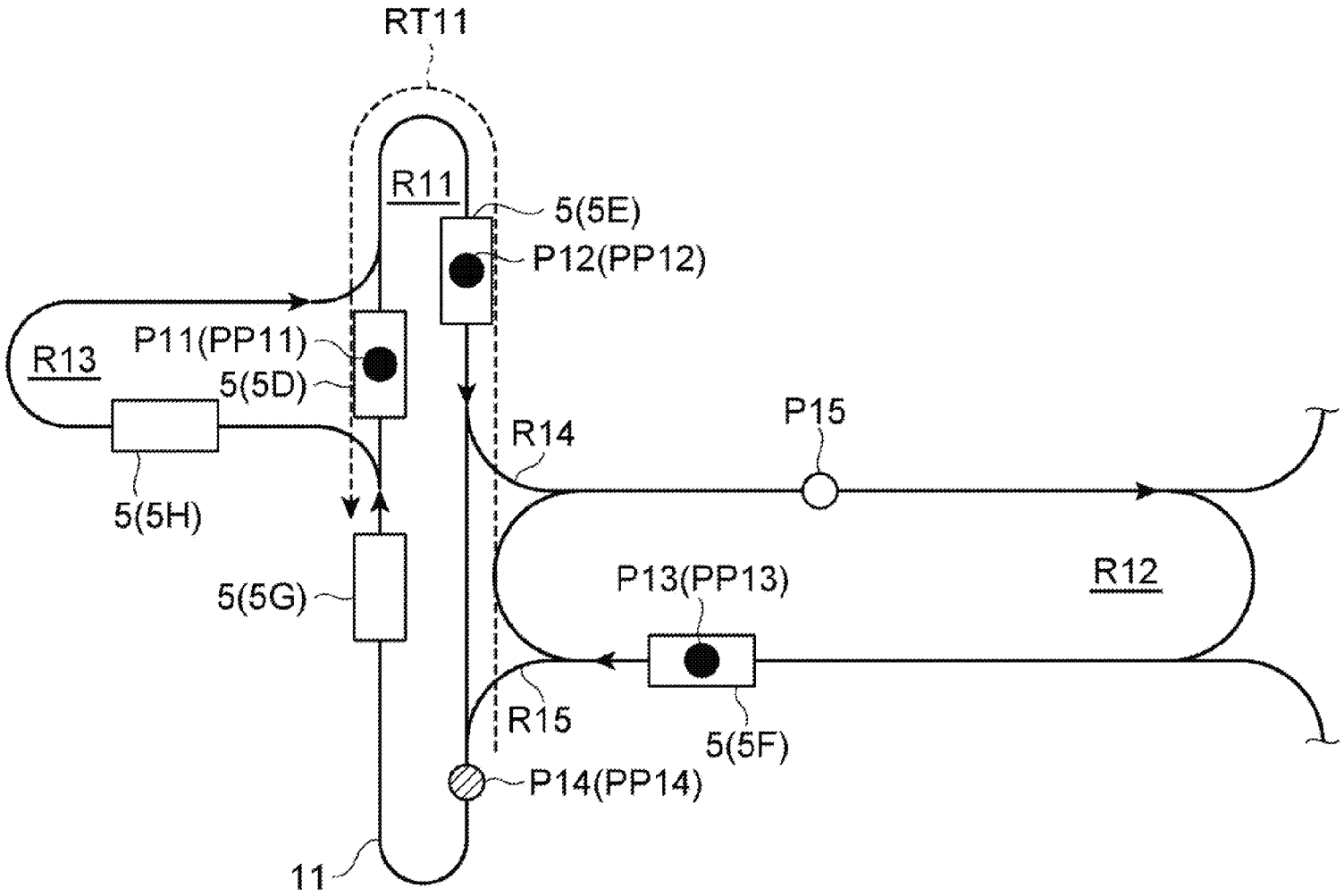
FIG. 6 is an explanatory diagram for describing the waiting control according to a preferred embodiment of the present invention.
Figure 7:
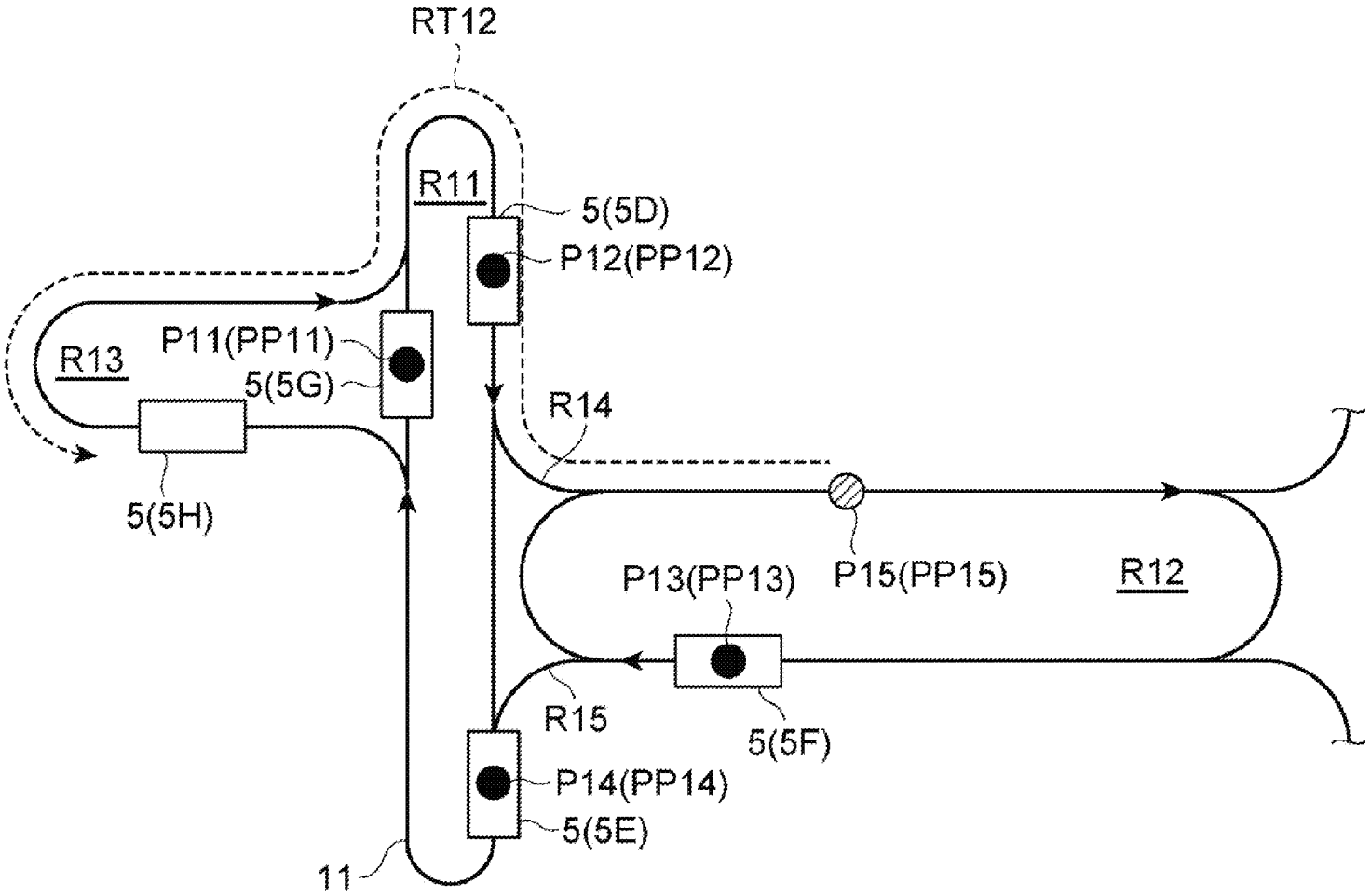
FIG. 7 is an explanatory diagram for describing the waiting control according to a preferred embodiment of the present invention by use of another track layout.
Figure 8:
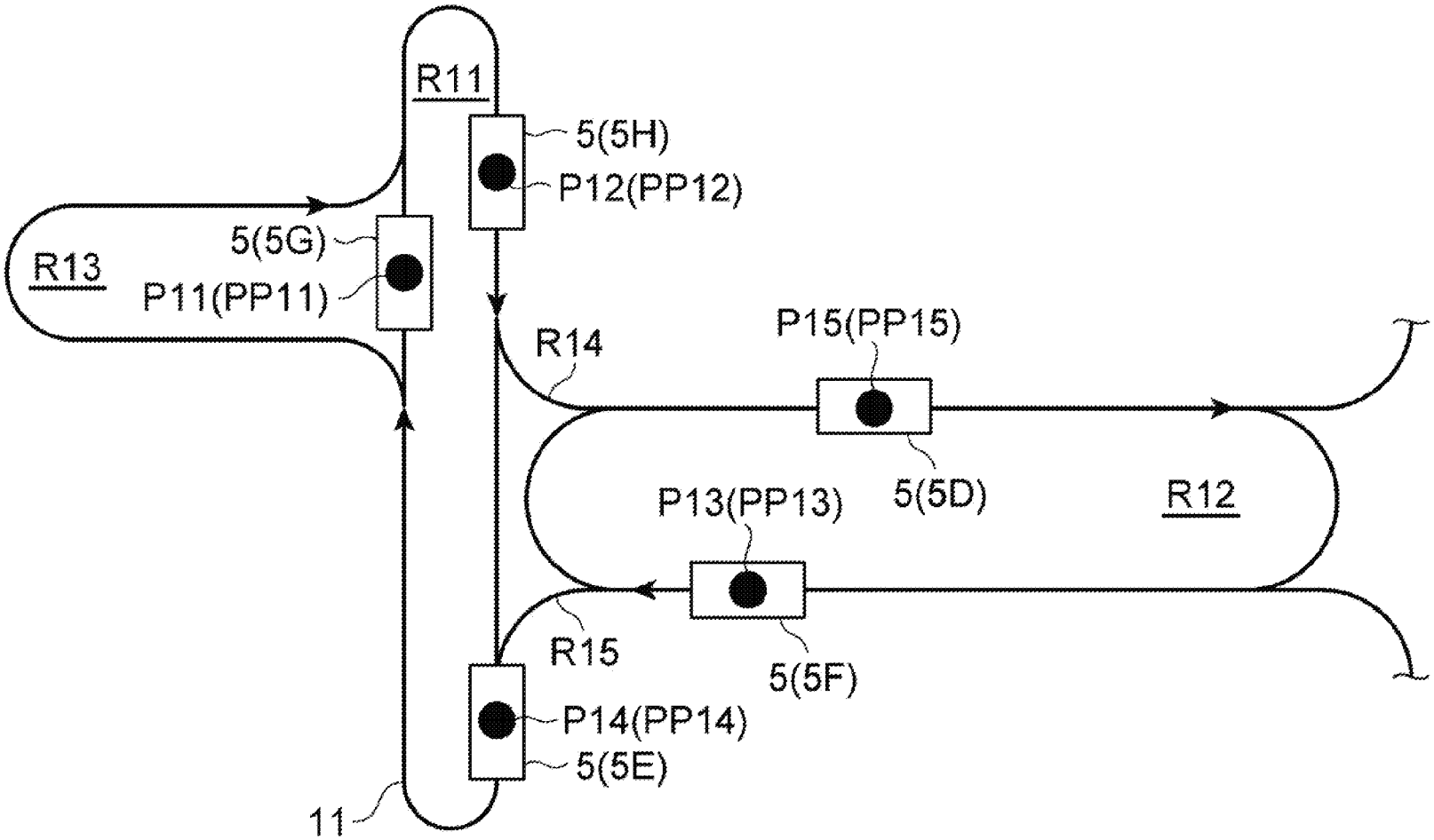
FIG. 8 is an explanatory diagram for describing the waiting control according to a preferred embodiment of the present invention by use of another track layout.

For example, the layout of the track 11 in the travelling vehicle system 1 is not limited to the above-described preferred embodiment. For example, as illustrated in FIGS. 6 to 8, there may be adopted a layout in which the track 11 includes two loop travelling routes R11, R12, two connection travelling routes R14, R15 that connect between the adjacent loop travelling routes R11, R12 so as to allow travelling therebetween, and a retraction route R13.

Hereinafter, assuming that the loop travelling routes R11, R12 and retraction route R13 are set such that the travelling vehicle 5 travels in a one-way clockwise manner, waiting control in the system controller 3 in this layout will be described mainly with reference to FIGS. 3 and 6 to 8. In the following, only the waiting control will be described and a description of the configuration of stations and the like will be omitted.

First, the empty travelling vehicle detection portion 41 makes an inquiry to each travelling vehicle 5 about loading or non-loading of the object to be conveyed in a constant cycle. Based on a response to the inquiry to the travelling vehicle 5, the empty travelling vehicle detection portion 41 detects whether or not the empty travelling vehicle has been newly generated. Here, as illustrated in FIG. 6, it is assumed that the empty travelling vehicle detection portion 41 has detected new empty travelling vehicles 5G, 5H (one empty travelling vehicles) (Step S1).

Next, the number-of-travelling-vehicles acquisition portion 45 acquires the number of empty travelling vehicles present on the track 11, and determines whether or not the number of waiting points is equal to the number of empty travelling vehicles (Step S2). Here, as illustrated in FIG. 6, the number of waiting points PP11, PP12, PP13 is 3 and the number of empty travelling vehicles 5D, 5E, 5F, 5G, 5H is 5, and hence the number-of-travelling-vehicles acquisition portion 45 determines that the number of waiting points PP11, PP12, PP13 is not equal to the number of empty travelling vehicles 5D, 5E, 5F, 5G, 5H (S2: NO).

In this case, the waiting point setting portion 42 additionally sets two waiting points (Step S3). In this case, as illustrated in FIG. 6, based on the predetermined rule, the waiting point setting portion 42 additionally sets two candidate points P14, P15 in the track 11 as waiting points PP14, PP15 (one waiting points) . Then, the number-of-travelling-vehicles acquisition portion 45 again acquires the number of empty travelling vehicles present on the track 11, and again determines whether or not the number of waiting points is equal to the number of empty travelling vehicles (Step S2). Here, the number of waiting points PP11, PP12, PP13, PP14, PP15 is 5 and the number of empty travelling vehicles 5D, 5E, 5F, 5G, 5H is 5, and hence the number-of-travelling-vehicles acquisition portion 45 determines that the number of waiting points PP11, PP12, PP13, PP14, PP15 is equal to the number of empty travelling vehicles 5D, 5E, 5F, 5G, 5H (S2: YES).

Next, the route searching portion 43 sets a target waiting point as the start point and a target empty travelling vehicle as the end point. Here, as illustrated in FIG. 6, the route searching portion 43 sets as the start point the one waiting point PP14 additionally set by the waiting point setting portion 42, and sets as the end point a position of the one empty travelling vehicle 5G detected by the empty travelling vehicle detection portion 41 (Step S4).

Next, the route searching portion 43 searches a route from the waiting point PP14 to the empty travelling vehicle 5G (Step S5). A broken-line arrow illustrated in FIG. 6 is a route RT11 searched by the route searching portion 43.

Next, the travelling command allocation portion 44 allocates the travelling command to the travelling vehicles 5D, 5E, 5G (Step S6) . Here, since the number of waiting points and the number of empty travelling vehicles in the route RT1 searched by the route searching portion 43 are plural, the travelling command allocation portion 44 allocates to each of the empty travelling vehicles 5E, 5D (the other empty travelling vehicles) the travelling command to move to the waiting point PP12 (the other waiting point) adjacent to the start point side or the waiting point PP14 (the one waiting point), while keeping the order of the empty travelling vehicles 5E, 5D that are arranged from the start point side to the end point side along the route RT11. Further, the travelling command allocation portion 44 allocates the travelling command to move the empty travelling vehicle 5G to the waiting point PP11 (the other waiting point) which will become empty by the movement of the empty travelling vehicle 5D, the waiting point PP11 being located on a farthermost end point side within the route RT1. Thus, as illustrated in FIG. 7, the empty travelling vehicle 5E moves to the waiting point PP14, the empty travelling vehicle 5D moves to the waiting point PP12, and the empty travelling vehicle 5G moves to the waiting point PP11.

Next, the travelling command allocation portion 44 determines whether or not the empty travelling vehicle not waiting at the waiting point is present (Step S7) . For example, as illustrated in FIG. 7, the travelling command allocation portion 44 determines that the empty travelling vehicle 5H not waiting at the waiting point is present (S7: YES).

Next, the route searching portion 43 again sets a target waiting point as the start point and a target empty travelling vehicle as the end point. Here, as illustrated in FIG. 7, the route searching portion 43 sets as the start point the one waiting point PP15 (the one waiting point) which is additionally set by the waiting point setting portion 42, and sets as the end point a position of the one empty travelling vehicle 5H (the one empty travelling vehicle) which is detected by the empty travelling vehicle detection portion 41 (Step S4).

Next, the route searching portion 43 searches a route from the waiting point PP15 to the empty travelling vehicle 5H (Step S5). A broken-line arrow illustrated in FIG. 7 is a route RT12 searched by the route searching portion 43.

Next, the travelling command allocation portion 44 allocates the travelling command to each of the travelling vehicles 5D, 5H (Step S6). Here, since the empty travelling vehicle 5D (the other empty travelling vehicle) is present in the route RT12 searched by the route searching portion 43, the travelling command allocation portion 44 allocates to the empty travelling vehicle 5D the travelling command to move to the waiting point PP15, and allocates to the travelling vehicle 5H the travelling command to move to the waiting point PP12 (the other waiting point) which will become empty by the movement of the empty travelling vehicle 5C. Accordingly, as illustrated in FIG. 8, the empty travelling vehicle 5D moves to the waiting point PP15, and the empty travelling vehicle 5H moves to the waiting point PP12.

Next, the travelling command allocation portion 44 determines whether or not the empty travelling vehicle not waiting at the waiting point is present (Step S7). Here, if it is determined that the empty travelling vehicle not waiting at the waiting point is not present (S7: NO), a series of waiting control is completed. By the waiting control in Step 51 to Step S7, it is possible to reliably make the respective empty travelling vehicles 5D to 5H wait at the respective waiting points PP11 to PP15.

Second Alternative Preferred Embodiment

In the travelling vehicle system 1 of the first alternative preferred embodiment, for example in FIG. 6, the description has been made by giving the example in which the route searching portion 43 extracts the route RT11 as a route with the waiting point PP14 (the one waiting point) set as the start point and the position of the empty travelling vehicle 5G (the one empty travelling vehicle) as the end point, but there may be extracted a route which is different from the above and passes through the candidate point P14, the candidate point P13, the candidate point P15, the candidate point P12, and the candidate point P11.

In the first alternative preferred embodiment, a movement distance of each of the empty travelling vehicles 5D, 5E, 5G is short as compared to that in the second alternative preferred embodiment, and hence each of the empty travelling vehicles 5D, 5E, 5G can be moved to the waiting point in a short period of time. Further, in the first alternative preferred embodiment, the number of waiting points at which the empty travelling vehicles are waiting in the route is small as compared to that in the second alternative preferred embodiment (two points in the first alternative preferred embodiment whereas three points in the second alternative preferred embodiment), and hence the frequency of forcing out the empty travelling vehicle waiting at the waiting point is kept low. That is, wasteful energy consumption is prevented.

Third Alternative Preferred Embodiment

In the travelling vehicle system 1 of the first alternative preferred embodiment, the description has been made by giving the example in which the route RT11 preferably is searched with the empty travelling vehicle 5G (the one empty travelling vehicle) as the first target, but the route may be searched with another empty travelling vehicle 5H (the one empty travelling vehicle) as the first target.

Further, in the travelling vehicle system 1 of the first alternative preferred embodiment, the candidate point P14 has been set as the first waiting point PP14, but the candidate point P15 may be set as the first waiting point PP15. Also in this case, the route may be searched with the empty travelling vehicle 5G (the one empty travelling vehicle) as the first target, or the route may be searched with another empty travelling vehicle 5H (the one empty travelling vehicle) as the first target.

Other Alternative Preferred Embodiments

In the travelling vehicle system 1 of each the above-described preferred embodiment and alternative preferred embodiments, the description has been made by giving the example in which the candidates for the waiting point preferably are preset as the candidate points, but the present invention is not limited thereto. For example, there can be adopted a configuration in which the waiting point can be set by the user setting an arbitrary point on the track 11.

In the travelling vehicle system 1 of each of the above-described preferred embodiment and alternative preferred embodiments, the description has been made by taking the overhead travelling vehicle 5 as one example of the travelling vehicle, but other examples of the travelling vehicle include an unmanned travelling vehicle and a stacker crane which travel on a track installed on the ground or a frame.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A travelling vehicle system comprising:

a predetermined one-way travelling route;

a plurality of travelling vehicles that travel along the travelling route; and a controller that allocates a travelling command to each of the travelling vehicles; wherein the controller is configured or programmed to include:

a detection portion that detects presence or absence of an empty travelling vehicle not loaded with an object to be conveyed;

a setting portion that additionally sets a waiting point such that a number of waiting points is equal to a number of the empty travelling vehicles present on the travelling route upon detection of the empty travelling vehicle by the detection portion, the waiting point being a point at which the empty travelling vehicle is made to wait on the travelling route;

a route searching portion that searches a route from a start point to an end point when one waiting point additionally set by the setting portion is taken as the start point and a position of one empty travelling vehicle is taken as the end point, the one empty travelling vehicle being detected by the detection portion and not waiting at the waiting point; and a travelling command allocation portion that allocates to the one empty travelling vehicle the travelling command to move to the one waiting point along the route when the other empty travelling vehicle is not present in the route searched by the route searching portion, or allocates to the other empty travelling vehicle the travelling command to move to the one waiting point and allocates to the one empty travelling vehicle the travelling command to move to the other waiting point which becomes empty by movement of the other empty travelling vehicle when the other empty travelling vehicle waiting at the other waiting point is present in the route searched by the route searching portion.

2. The travelling vehicle system according to claim 1, wherein, when a number of the other waiting points and a number of the other empty travelling vehicles are plural, the travelling command allocation portion allocates to each of the other empty travelling vehicles the travelling command to move to the one waiting point adjacent to a start point side or the other waiting point while keeping order of the other empty travelling vehicles arranged from the start point side to an end point side along the route, and allocates the travelling command to move the one empty travelling vehicle to the other waiting point which becomes empty by the movement of the other empty travelling vehicle, the other waiting point being located on a farthermost end side within the route.

3. The travelling vehicle system according to claim 1, wherein the detection portion detects presence or absence of the empty travelling vehicle at preset setting time intervals.

4. The travelling vehicle system according to claim 1, further comprising an abnormality determination portion that determines occurrence of an abnormality in the one empty travelling vehicle when the one empty travelling vehicle does not arrive at the waiting point instructed by the travelling command within a predetermined time after the travelling command allocation portion allocates the travelling command to the one empty travelling vehicle.

5. The travelling vehicle system according to claim 1, wherein, when a plurality of the routes are extracted, the route searching portion selects the route having a shortest distance from the start point to the end point.

6. The travelling vehicle system according to claim 1, wherein, when a plurality of the routes are extracted, the route searching portion selects the route having a minimum number of the other waiting points at which the other empty travelling vehicles are waiting.

* * * * *